US008161981B2

(12) United States Patent
Price

(10) Patent No.: US 8,161,981 B2
(45) Date of Patent: Apr. 24, 2012

(54) HAIRSTYLING APPARATUS

(76) Inventor: Jennifer Price, Evansville, IN (US)

( * ) Notice: Subject to any disclaimer, the term of this patent is extended or adjusted under 35 U.S.C. 154(b) by 201 days.

(21) Appl. No.: 12/572,941

(22) Filed: Oct. 2, 2009

(65) Prior Publication Data

US 2011/0079237 A1 Apr. 7, 2011

(51) Int. Cl.
*A45D 2/40* (2006.01)
*A45D 1/04* (2006.01)

(52) U.S. Cl. ..... 132/224; 132/225; 219/225

(58) Field of Classification Search ..... 132/224, 132/225; 219/222, 225, 229
See application file for complete search history.

(56) References Cited

U.S. PATENT DOCUMENTS 4,739,151 A * 4/1988 Smal ..... 219/225
2005/0051188 A1* 3/2005 Leung ..... 132/224
2007/0209673 A1* 9/2007 Choi ..... 132/224
2009/0260650 A1* 10/2009 Jung ..... 132/224
* cited by examiner

*Primary Examiner* — Robyn Doan
(74) *Attorney, Agent, or Firm* — Jerry Haynes; Law Office of Jerry D. Haynes, P.A.

(57) ABSTRACT

The present invention relates to a hairstyling apparatus for styling hair comprising: a first element, where said first element includes a first front portion and a first rear portion, where said first front portion includes a first heatable plate; a second element, where said second element includes a second front portion and a second rear portion, where the second front portion includes a second heatable plate, where the first element and second element are connected to each other at one end and the first heatable plate and the second heatable plate are in facing engagement with each other; and a power supply mechanism where said power supply mechanism supplies electrical power to the hairstyling apparatus. The first element and second element are pivotally attached to each other and may be attached via a hinge mechanism or a snap fitting.

7 Claims, 1 Drawing Sheet

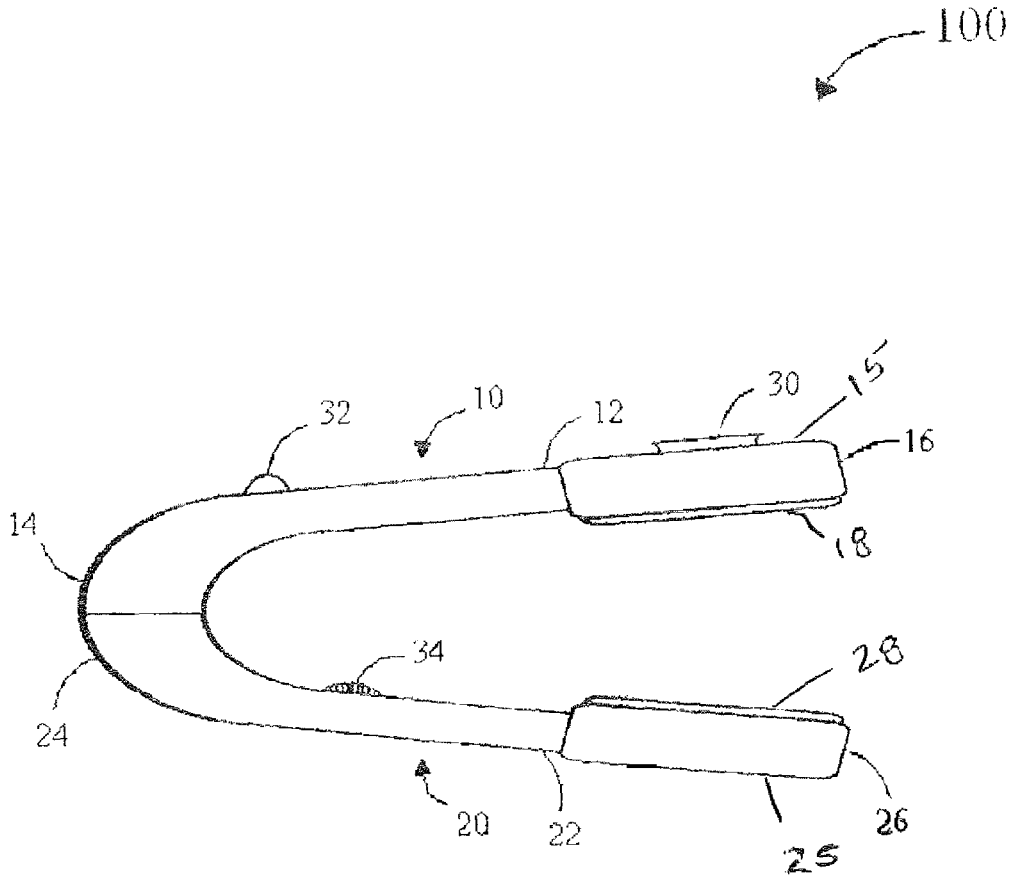
100
32
10
12
30
15
16
14
18
34
28
24
20
22
26
25

HAIRSTYLING APPARATUS

I. FIELD OF THE INVENTION

The present invention generally relates to an apparatus for styling hair, and more specifically, to a hairstyling apparatus for straightening hair from roots thereof.

II. MOTIVATION FOR THE INVENTION

Hairstyling industry has come a long way from rigid dictates of fashion statement to a trend toward informality and individualism. Hairstyling is an art of arranging hair and has been an important part of fashion industry from time immemorial. Till the last century, fashionable hair styles generally used to be prerogative of the wealthy and the upper class. However, today men and women in of all walks of life are conscious about their hair styles and are vocal about their choices and preferences. People visit beauty salons for straightening, curling or styling hair. Individual choices and preferences of people have increased work of beauticians, cosmeticians, and hairstylists significantly. In order to cater to the individual choices and preferences, these hairstylists take every step to ensure that people visiting their salon are provided the best services. The hairstylists utilizes various apparatuses and appliances such as, hairbrushes, scissors, hair dryers, hair straightening apparatuses, curling irons, and the like, for accomplishing the jobs of straightening, curling and styling hair.

Hair straightening is a tedious job and requires utmost care, special appliances such as hair straightening apparatuses, and extraordinary skills of the hairstylist. A conventional hair straightening apparatus comprises a pair of heatable plates hinged at one end, with each heatable plate including a heating element. Further, a power cable is provided for connection to a power supply in order to heat the heating element. The heatable plates are usually made of metal. The conventional hair straightening apparatus has been in use for a considerable period of time in the hairstyling industry. However, the conventional hair straightening apparatus poses various difficulties for the hairstylists as well as people undergoing hair straightening. The conventional hair straightening apparatuses are limited in functionality as a conventional hair straightening apparatus cannot be employed near a person's scalp. More specifically, the heatable plates are hot and may be injurious and risky for the person undergoing hair straightening treatment. Further, mobility of the conventional hair straightening apparatus is limited as the conventional hair straightening apparatus has to be kept electrically connected during the hair straightening procedure. Accordingly, the conventional hair straightening apparatus hampers movement and usage thereof.

Furthermore, complete straightening of hair may not be achieved using the conventional hair straightening apparatus, as new hair growth of the hair portion near the scalp, i.e. roots of the hair cannot be brought in contact with the conventional hair straightening apparatus. Also, the use of metal heatable plates may be uncomfortable for a person undergoing the hair straightening treatment. Moreover, the conventional hair straightening apparatus are heavier in weight and as such may be tiresome and uncomfortable for the hairstylist to use.

Accordingly, there persists a need for a hairstyling apparatus for straightening hair, that is lightweight, portable, easy to use and having low production cost.

Therefore, it is an object of the present invention to obviate the above and other disadvantages from existing art and to provide a hairstyling apparatus for straightening hair which straightens the hair completely and does not pose any hazard or risk to a person undergoing a hair straightening treatment.

It is further an object of the present invention to provide a hairstyling apparatus which may be comfortable to hold for a user.

III. SUMMARY OF THE INVENTION

The present invention relates to a hairstyling apparatus for styling hair comprising: a first element, where said first element includes a first front portion and a first rear portion, where said first front portion includes a first heatable plate; a second element, where said second element includes a second front portion and a second rear portion, where the second front portion includes a second heatable plate, where the first element and second element are connected to each other at one end and the first heatable plate and the second heatable plate are in facing engagement with each other; and a power supply means where said power supply means supplies electrical power to the hairstyling apparatus. The first element and second element are pivotally attached to each other and may be attached via a hinge mechanism or a snap fitting. The first heatable plate and the second heatable plate may be made of a ceramic material, a metal material or a glass material. In one exemplary embodiment, the hairstyling apparatus may further comprise a detachable root straightener plate configured on the first element.

III. DESCRIPTION OF THE DRAWING

The advantages and features of the present invention will become better understood with reference to the description taken in conjunction with the accompanying drawing, in which:

FIG. 1 illustrates a perspective view of a hairstyling apparatus, in accordance with an exemplary embodiment of the present invention.

IV. DESCRIPTION OF THE INVENTION

The best mode for carrying out the invention is presented in terms of its preferred embodiment, herein depicted in FIG. 1. The preferred embodiments described here in detail for illustrative purposes are subject to many variations. It is understood that various omissions and substitutions of equivalents are contemplated as circumstances may suggest or render expedient, but are intended to cover the application or implementation without departing from the spirit or scope of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a hairstyling apparatus for straightening hair. The present invention finds its utility in homes and commercial places such as beauty parlors and salons. It is envisioned that the present invention can be easily incorporated into a multitude of utility which includes but is not limited to, straightening hair, curling hair, and conditioning hair. However, for the sake of brevity, a hairstyling apparatus for straightening hair has been described as an exemplary embodiment of the present invention.

As illustrated in FIG. 1, the present invention provides a hairstyling apparatus 100 for straightening hair. The hairstyling apparatus 100 comprises a first element 10 having a first front portion 12 and a first rear portion 14; and a second element 20 having a second front portion 22 and a second rear portion 24. The first element 10 and the second element 20 are connected to each other at one end. More specifically, the first rear portion 14 of the first element 10 and the second rear portion 24 of the second element 20 are pivotally attached to each other. Attachment of the first element 10 and the second element 20 may be achieved by any means know in the art. In an embodiment of the present invention, the first element 10 and the second element 20 may be connected by a hinge mechanism (not shown). In another embodiment of the present invention, the first element 10 may be snap fitted with the second element 20. However, it will be evident to a person skilled in the art, that the present invention is not limited to the attachment as explained herein. Accordingly, any other attachments known in the art may also be employed to attach the first element 10 and the second element 20. Further, the first element 10 and the second element 20 are configured in a manner so as to meet in facing engagement. Furthermore, the first element 10 and the second element 20 of the hairstyling apparatus 100 includes an ergonomic design for being comfortably held in a hand of a user, such as a hairstylist operating the hairstyling apparatus 100.

The first element 10 comprises a first heatable plate 16 disposed thereon. More specifically, the first front portion 12 of the first element 10 is configured to include the first heatable plate 16. Similarly, the second front portion 22 of the second element 20 is configured to include a second heatable plate 26. The first heatable plate 16 and the second heatable plate 26 are made of ceramic material. However, it will be evident to a person skilled in the art that other materials such as metal or glass may also be used for manufacturing the first heatable plate 16 and the second heatable plate 26. The first heatable plate 16 and the second heatable plate 26 are in facing engagement with each other. The firste heatable plate 16 includes a heated surface 18 and an outer surface 15. The second heatable plate 26 includes a heated surface 28 and an outer surface 25. Both the heated surface 18 and the heated surface 28 face toward each other on the inner portion of each respective heatable plate. More specifically, the first heatable plate 16 and the second heatable plate 26 are configured to hold the hair therebetween for straightening.

Further, the hairstyling apparatus 100 includes a root straightener plate 30 configured on the first element 10 on the outer surface 15. The root straightener plate 30 enables straightening of roots of the hair. The root straightener plate 30 is operated electrically by means of an operating mechanism 32 configured on the first element 10. More specifically, the root straightener plate 30 is functional upon activation of the operating mechanism 32, as such precluding any accidental harm to the person undergoing the hair straightening treatment.

The hairstyling apparatus 100 further includes a temperature regulating mechanism 34. The temperature regulating mechanism 34 regulates temperature of the first heatable plate 16, the second heatable plate 26 and the root straightener plate 30. In an embodiment of the present invention, the temperature regulating mechanism 34 may regulate temperature up to about 465° F. Further, the hairstyling apparatus 100 includes a digital display (not shown) such as an LCD display screen for displaying temperature in order to assist the hairstylist to regulate the temperature.

Furthermore, the hairstyling apparatus 100 may include an electrical power supply means (not shown) capable of providing electrical power thereto. In one exemplary embodiment of the present invention, the hairstyling apparatus 100 may include a cord for electrically connecting the hairstyling apparatus 100 to an AC power supply. In another embodiment of the present invention, the hairstyling apparatus 100 may be operable by a battery that supplies DC power. In yet another alternative embodiment of the present invention, the hairstyling apparatus 100 may be operable by utilizing either a power supply cord or a battery.

The temperature of the first heatable plate 16 and the second heatable plate 26 may be increased to a desired value. More specifically, the temperature may be set by means of the temperature regulating mechanism 34. Further, the value of the selected temperature may be visible on the digital display. After the first heatable plate 16 and the second heatable plate 26 reaches to the selected temperature, the user may bring the first heatable plate 16 and the second heatable plate 26 towards each other to close around hair strands for straightening. Thereafter, the hairstyling apparatus 100 may be slid relative to the strands of the hair. Further, for straightening of new hair growth or the hair near a scalp or the roots of the hair, the root straightener plate 30 may be utilized. The root straightener plate 30 may be operated by means of the operating mechanism 32.

The best mode for carrying out the present invention is presented in terms of its preferred embodiment, herein illustrated with reference to FIG. 1. However the present invention is not limited to the described embodiment and a person skilled in the art will appreciate that many other embodiments of the present invention are possible without deviating from the basic concept of the present invention and any such work around will also fall under scope of the present invention.

The hairstyling apparatus 100 may be made in multitude of size and shapes in order to meet preferences, choices and requirements of different users. The structural configuration of the hairstyling apparatus 100 is simple and user friendly that improves ergonomic comfort and control thereof.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

What is claimed is:

1. A hairstyling apparatus for styling hair comprising:

a. a first element, where said first element includes a first front portion and a first rear portion, where said first front portion includes a first heatable plate, where said first heatable plate includes a heated surface and an outer surface;

b. a second element, where said second element includes a second front portion and a second rear portion, where the second front portion includes a second heatable plate, where said second heatable plate includes a heated surface and an outer surface, where the first element and second element are connected to each other at one end and the heated surface of the first heatable plate and the heated surface of the second heatable plate are in facing engagement with each other;

c. a root straightener plate configured the outer surface of the first heatable plate; and d. a power supply means where said power supply means supplies electrical power to the hairstyling apparatus.

2. The hairstyling apparatus according to claim 1, where said first element and second element are pivotally attached to each other.

3. The hairstyling apparatus according to claim 1, where the first heatable plate and the second heatable plate are made of at least one of a ceramic material, a metal material and a glass material.

4. The hairstyling apparatus according to claim 1, further comprising a temperature regulating mechanism, where said temperature regulating mechanism regulates the temperature of the first heatable plate, the second heatable plate and the root straightener plate.

5. The hairstyling apparatus according to claim 4, where the temperature regulating mechanism regulates temperatures up to about 465° F.

6. The hairstyling apparatus according to claim 4, further including a digital display for displaying temperature to assist in regulating the temperature of the temperature regulating mechanism.

7. The hairstyling apparatus according to claim 1, where said power supply means includes at least one of a power cord for AC power and a battery for DC power.

* * * * *